United States Patent [19]

Deutsch

[11] 4,453,441

[45] Jun. 12, 1984

[54] FREQUENCY MODULATOR FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 447,080

[22] Filed: Dec. 6, 1982

[51] Int. Cl.[3] ..... G10H 1/06

[52] U.S. Cl. ..... 84/1.22; 84/1.24; 84/1.01

[58] Field of Search ..... 84/1.01, 1.03, 1.19, 84/1.21, 1.22, 1.23, 1.24

[56] References Cited

U.S. PATENT DOCUMENTS 4,253,367 3/1981 Hiyoshi et al. ..... 84/1.22

*Primary Examiner*—Forester W. Isen

*Attorney, Agent, or Firm*—Ralph Deutsch

[57] ABSTRACT

A keyboard operated electronic musical instrument is disclosed which has a number of tone generators that are assigned to actuated keyswitches. A tone generation computation means is implemented using a combination of an even symmetric function and an odd symmetric function. One of these functions is scaled in magnitude in response to a modulation control signal. The scaled and unscaled functions are combined to produce a musical waveshape which is frequency modulated by changes in the level of the modulation control signal.

13 Claims, 8 Drawing Figures

FREQUENCY MODULATOR FOR AN ELECTRONIC MUSICAL INSTRUMENT

BACKGROUND OF THE INVENTION

1. Field of the Invention

This invention relates to electronic musical tone synthesis and in particular is concerned with the generation of frequency modulation tonal effects.

2. Description of the Prior Art

A musical tone generator which creates a waveshape that is time invariant will have a mechanical-like tone quality which easily fatigues a listener. This a negative reaction to a time invariant tone stimulus is a subjective emotion which can be attributed to a fatigue phenomena produced by an unchanging audible stimulation. Even a supposedly mechanical-like tone generator such as a wind blown organ pipe does not produce a constant time invariant audible sound. Turbulances in the air source produce noise-like tone modulations which are sufficient to provide amplitude and frequency tone modulations that combine to render the pipe tone less fatiguing to a listener.

A variety of prior art systems have been designed which introduce a frequency modulation to provide a time variant quality to a generated musical sound. In U.S. Pat. No. 3,794,748 entitled "Apparatus And Method For Frequency Modulation For Sampled Amplitude Signal Generating System" a system is described wherein a musical tone has a fundamental frequency which is frequency modulated. The disclosed system generates a musical tone by sequentially and repetitively addressing out a set of waveshape data points stored in a memory. The memory addresses are determined by a frequency number that is associated with an actuated keyboard switch. A frequency modulation is obtained by varying the assigned frequency number in a time variant manner.

In U.S. Pat. No. 4,175,464 entitled "Musical Tone Generator With Time Variant Overtones," there is described a tone generator in which waveform amplitude data is generated from a table of sinusoid values in an addressable memory by changing the addresses as a function of time in a periodic or sinusoidal manner. The effect is to produce a sequence of sinusoidal values from the table which correspond to a series of points on a frequency modulated carrier signal. By making the effective modulation frequency equal to the carrier frequency, the resulting frequency modulated signal corresponds to a carrier with side bands that correspond to the harmonics of the carrier.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created. At the end of each computation cycle, the computed master data set is stored in a main register.

The master data set is computed as the sum of two periodic waveshapes which are mutually orthogonal. Controlled frequency modulation effects are obtained by scaling one of the period waveshapes. The scaling factor is selected in response to a modulation control signal which can be a time variant signal. The computations during a computation cycle are implemented at a fast rate which may be nonsynchronous with any musical frequency.

Following each computation cycle, a transfer cycle is initiated during which the stored master data set is transferred from the main register to preselected members of a multiplicity of tone generators and stored in a note register which is an element of each of the individual tone generators. The output tone generation continues uninterrupted during the computation and transfer cycles.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a tone generator in which musical tones are generated by computing a waveshape having a frequency modulation with respect to the fundamental frequency. The tone generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all the elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer or correspond to combinations of several elements appearing in the referenced patent.

Figure 1:
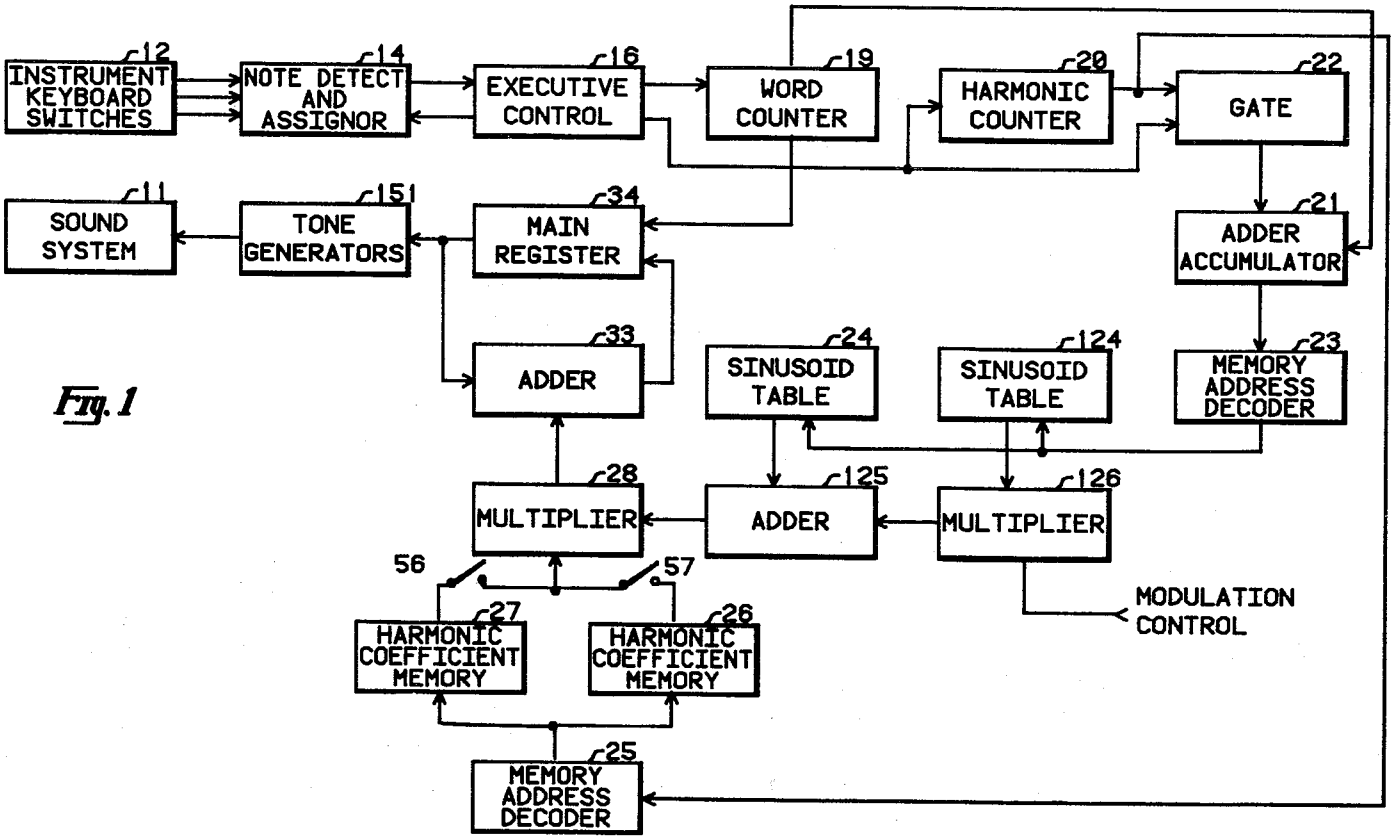
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard switches. The array is contained in the system block labeled keyboard switches 12. If one or more of the keyboard switches have a switch status change and are actuated ("on" position) on the instrument's keyboard, the note detect and assignor 14 stores the corresponding note information for the actuated keyswitches and one member of the set of tone generators 151 is assigned to each actuated keyswitch. A suitable note detect and assignor subsystem is described in U.S. Pat. No. 4,022,098 which is hereby incorporated by reference.

When one or more keyswitches on the keyboards have been actuated, the executive control 16 initiates a sequence of computation cycles. During each computation cycle, a master data set consisting of 64 data words is computed in a manner described below and stored in the main register 34. The 64 data words in the master data set are generated using 32 harmonic coefficients that are stored in the harmonic coefficient memories 27 and 26. The selection of a particular combination of harmonic coefficients is controlled by the setting of the tone switches 56 and 57. The tone switches are often called stops or stop switches.

The 64 data words in the master data set correspond to the amplitudes of 64 equally spaced points of one cycle of the audio waveform for the musical tone produced by the tone generators 151. The general rule is that the maximum number of harmonics in the audio tone spectra is no more than one-half of the number of data points in one complete waveshape period. Therefore, a master data set comprising 64 data words corresponds to a maximum of 32 harmonics.

At the completion of each computation cycle in the sequence of computation cycles, a transfer cycle is initiated during which the master data set residing in the main register 34 is transferred to note registers which are elements of each member of the set of tone generators contained in the system block labeled tone generators 151. These note registers store the 64 data words comprising the master data set. The data words stored in the note registers are read out sequentially and repetitively and transferred to a digital-to-analog converter which converts the digital data words into an analog waveshape. The digital-to-analog converter is contained in the system block labeled sound system 11. The musical waveshape is transformed into an audible sound by means of a sound system consisting of a conventional amplifier and speaker subsystem which are also contained in the system block labeled sound system 11. The stored data is read out of each note register at an address advance rate corresponding to the fundamental frequency of the note corresponding to the actuated keyswitch to which a tone generator has been assigned.

As described in the referenced U.S. Pat. No. 4,085,644 it is desirable to be able to continuously recompute and store the generated master data set during a sequence of computation cycles and to load this data into the note registers while the actuated keys remain depressed on the keyboards. This system function is accomplished without interrupting the flow of data points to the digital-to-analog converter at the read out clock rates.

In the manner described in the referenced U.S. Pat. No. 4,085,644 the harmonic counter 20 is initialized at the start of each computation cycle. Each time that the word counter 19 is incremented so that it returns to its initial state because of its modulo counting implementation, a signal is provided which increments the count state of the harmonic counter 20. The word counter 19 is implemented to count modulo 64 which is the number of data words in the master data set which is generated and stored in the main register 34. The harmonic counter 20 is implemented to count modulo 32. This number corresponds to the maximum number of harmonics consistent with a master data set comprising 64 words.

At the start of each computation cycle, the contents of the accumulator contained in the adder-accumulator 21 is initialized to a zero value. Each time that the word counter 19 is reset to its initial value, the accumulator is reset to a zero value. Each time that the word counter 19 is incremented, the accumulator adds the current count state of the harmonic counter 20 to the sum contained in the accumulator.

The content of the accumulator in the adder-accumulator 21 is used by memory address decoder 23 to address out trigonometric sinusoid values from the sinusoid table 24 and the sinusoid table 124. The sinusoid table 24 is implemented as a read only memory storing values of the trigonometric function sin $(2\pi\phi/64)$ for $0 \leqq \phi \leqq 64$ at intervals of D. The sinusoid table 124 is implemented as a read only memory storing values of the trigonometric function cos $(2\pi\phi/64)$ for $0 \leqq \phi \leqq 64$ at intervals of D. D is a table resolution constant.

The multiplier 126 multiplies the trigonometric value read out of the sinusoid table 124 by a modulation scale factor. The magnitude of the modulation scale factor is determined by the modulation control signal. To obtain frequency modulation tonal effects, the modulation control signal must be varied in magnitude as a function of time. A constant time-invariant magnitude of the modulation control signal will not affect the audible output tone produced by the tone generators 151. A wide range of implementations can be used to produce the modulation control signal. A variable frequency oscillator can be used. An ADSR (attack/decay/sustain/release) envelope function can be used for the modulation control signal. A suitable ADSR envelope generator is described in U.S. Pat. No. 4,079,650. This patent is hereby incorporated by reference.

The data values from the output of the sinusoid table 24 and the multiplier 126 are summed in the adder 125 and provided as one of the signal inputs to the multiplier 28. The multiplier 28 is used to multiply the output data value from the adder 125 by harmonic coefficient valules that are read out of the harmonic coefficient memories 26 and 27 in response to addresses provided by the memory address decoder 25. The memory address decoder provides a memory address corresponding to the count state of the harmonic counter 20. Switches 56 and 57 are selectively actuated to determine the set of harmonic coefficients which are provided to the multiplier 28. The produced value formed by the multiplier 28 is furnished as one input to the adder 33.

The contents of the main register 34 are initialized to a zero value at the start of a computation cycle. Each time that the word counter 19 is incremented, the contents of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 32 complete count cycles of 64 counts, the main register 34 will contain the master data set corresponding to the selected musical tone according to the actuation states of the tone switches, or stops, 56 and 57.

As described in the referenced U.S. Pat. No. 4,085,644 the master data set has values which are given the expression $$z_n = \sum_{q=1}^{N/2} c_n \sin(2\pi nq/N) \quad \text{Eq. 1}$$

where n is an address number in the main register, q is the harmonic number, and N=64. In the present invention, because of the addition of the trigonometric terms read out of the sinusoid table 124, the master data set has values which are given by the expression $$z_n = z_n' + A(t) \sum_{q=1}^{N/2} c_n \cos(2\pi nq/N) \quad \text{Eq. 2}$$

Eq. 2 can be written in an equivalent form as $$z_n = B(t) \sum_{q=1}^{N/2} \sin[2\pi nq/N + \Theta(t)] \quad \text{Eq. 3}$$

where the amplitude time-variant factor is $$B(t)=[1+A(t)^2]^{\frac{1}{2}} \quad \text{Eq. 4}$$

and the time-variant phase angle is $$\theta(t)=\arctan\,[1/A(t)] \quad \text{Eq. 5}$$

It is noted that since the phase angle $\theta(t)$ is a function of time, then the master data set corresponds to a frequency modulated wave when considered as a sequence of master data sets computed during a repetitive sequence of computation cycles.

It is noted that if the sinusoid table 24 stores values of the trigonometric function $\cos(2\pi n/64)$ and that if the sinusoid table 124 stores values of the trigonometric function $\sin(2\pi n/64)$ then the master data set values correspond to the expression $$z_n = \sum_{q=1}^{N/2} c_n \cos(2\pi nq/N) + A(t) \sum_{q=1}^{N/2} c_n \sin(2\pi nq/N) \quad \text{Eq. 6}$$

Eq. 6 can be written in an equivalent form as $$z_n = B(t) \sum_{q=1}^{N/2} \sin[2\pi nq/N + \beta(t)] \quad \text{Eq. 7}$$

where the amplitude time factor B(t) is the same as that shown in Eq. 4 and the time-variant phase angle is $$\beta(t)=\arctan A(t) \quad \text{Eq. 4}$$

The important observation is that the generation of a frequency modulated wave is the result of adding two orthogonal functions of unequal and time variant magnitudes and where one orthogonal function has an even symmetry and the second orthogonal function has an odd symmetry. Thus, as described in the referenced U.S. Pat. No. 4,085,644 the Walsh functions Cal and Sal can be used in place of the trigonometric values cosine and sine.

Figure 2:
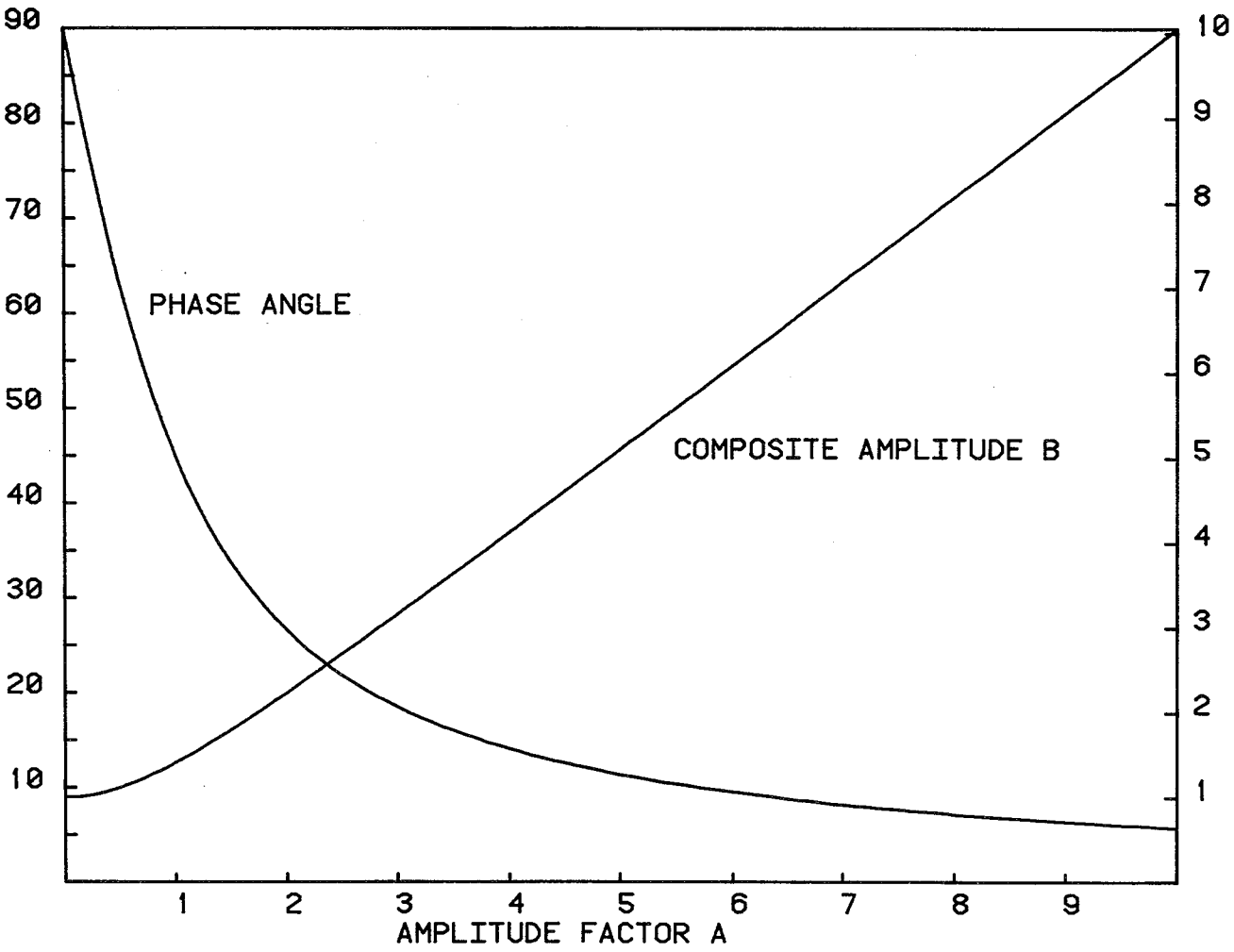
FIG. 2 is a graph of phase angle as a function of amplitude of the orthogonal function.

FIG. 2 is a graph showing the relation of the phase angle as a function of the amplitude factor A. The abscissa is the value of A. The phase shift curve has a maximum value for the zero value of A. It is understood that A is permitted to have both positive and negative values. The negative values produce a reflection of the curve about the A=0 axis. It is noted that for values of A greater than approximately A=1, the composite amplitude factor B is approximately equal to the scale factor A provided by the modulation control. The right scale factors correspond to the values of the composite amplitude factor B.

Figure 3:
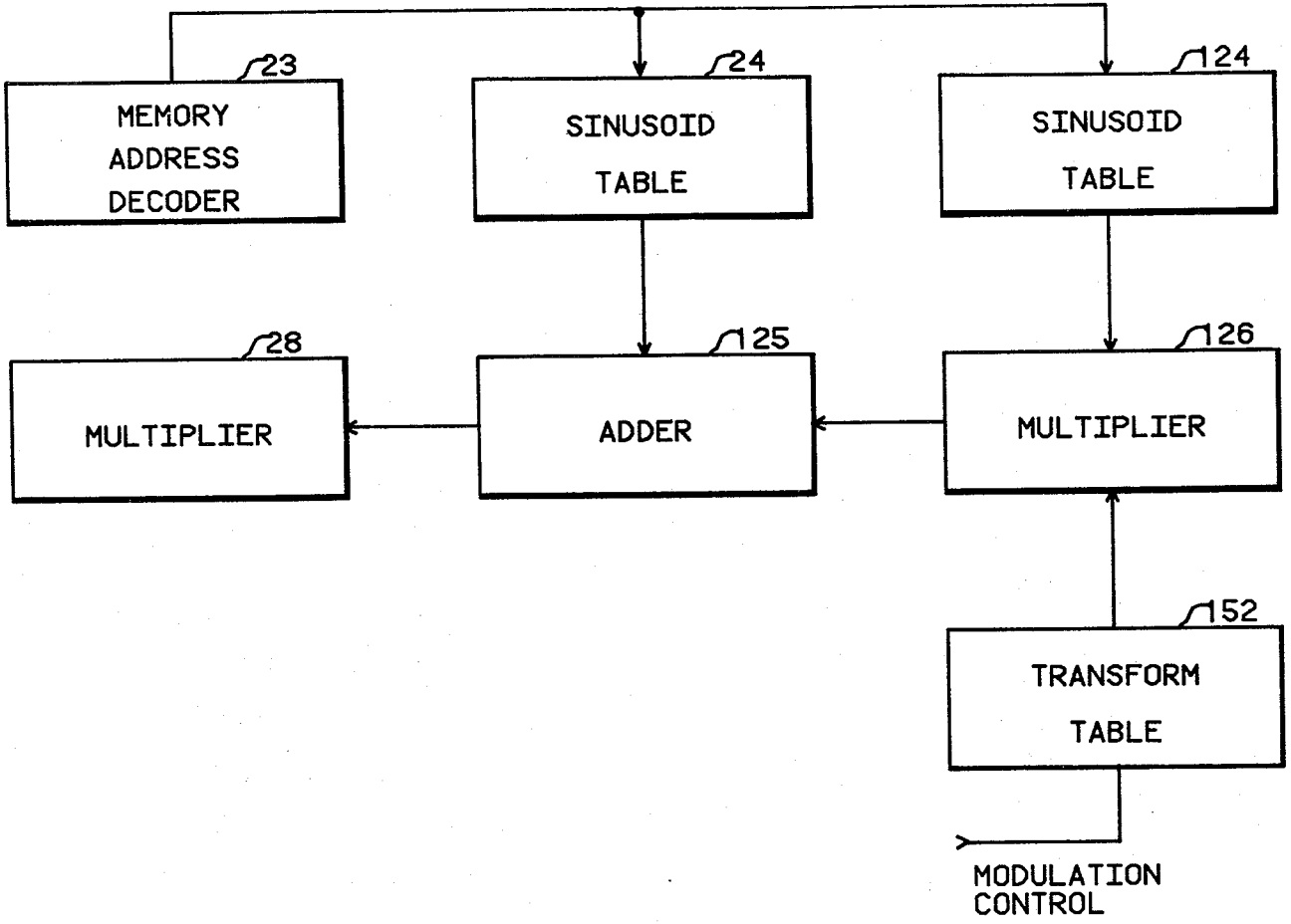
FIG. 3 is a schematic diagram of a linearizing function.
Figure 4:
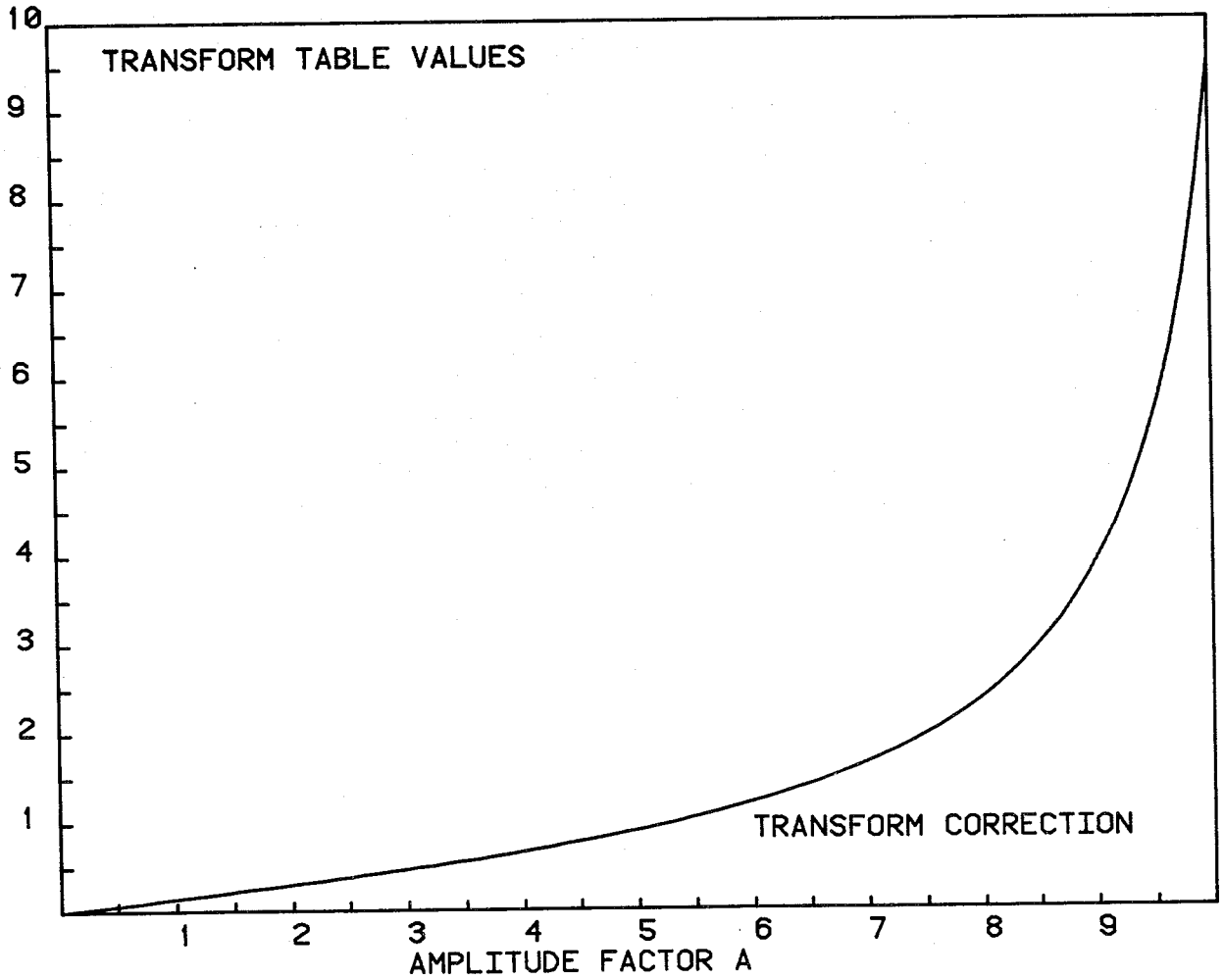
FIG. 4 is a plot of data stored in transform table 152.

Because of the nonlinear relation between the modulation control signal A and the phase angle, a transformation is sometimes desirable so that the resulting phase angle change is a linear function of the modulation control signal A. FIG. 3 illustrates a modification to the system shown in FIG. 1 which will produce the linear functional relation. The modulation control signal is used to address values out of the transform table 152. The transform table 152 stores a table of values corresponding to the data shown in FIG. 4.

Figure 5:
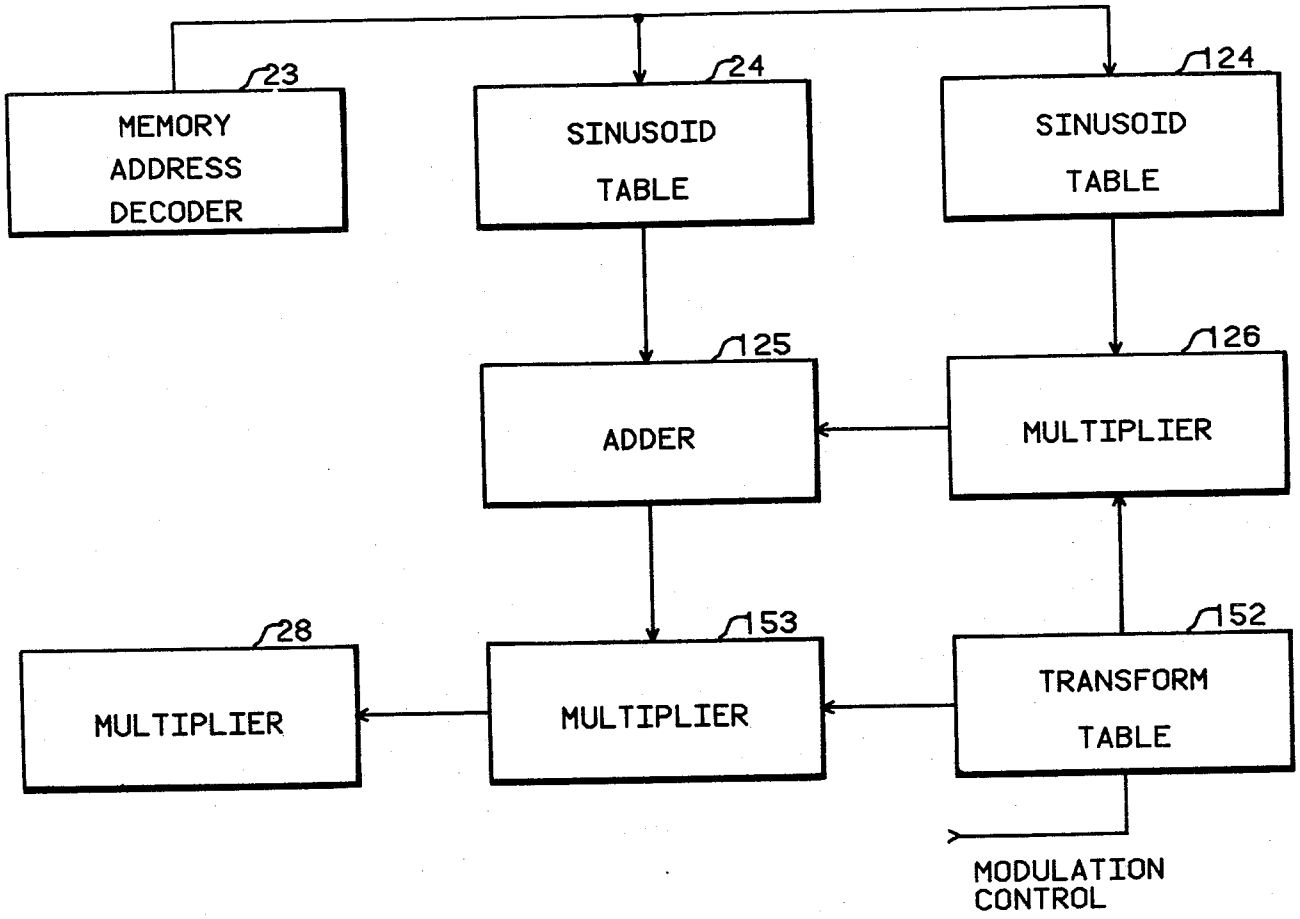
FIG. 5 is a schematic diagram of a linear control version of the invention.

The variation in the amplitude B that accompanies the phase angle modulation produces a characteristic musical effect. For other musical effects, the amplitude variations can be eliminated using a system such as that shown in FIG. 5. In this version, each entry in the transform table 152 consists of two data words. The first set of data words addressed out in response to the modulation control signal and furnished to the multiplier 126 corresponds to the data values shown in FIG. 4. The second set of data words addressed out in response to the modulation control signal and furnished to the multiplier 153 corresponds to the data values shown in FIG. 6. Using the two transformation data the amplitude of the data furnished to the multiplier 28 is independent of the magnitude of the modulation control signal and the phase angle variation is a linear function of the magnitude of the modulation control signal.

The present invention can also be incorporated into other tone generators of the type that synthesize musical waveshapes by implementing a Fourier-type transformation on a set of harmonic coefficients. A system of this type is described in U.S. Pat. No. 3,809,786 entitled "Computor Organ." This patent is hereby incorporated by reference.

Figure 6:
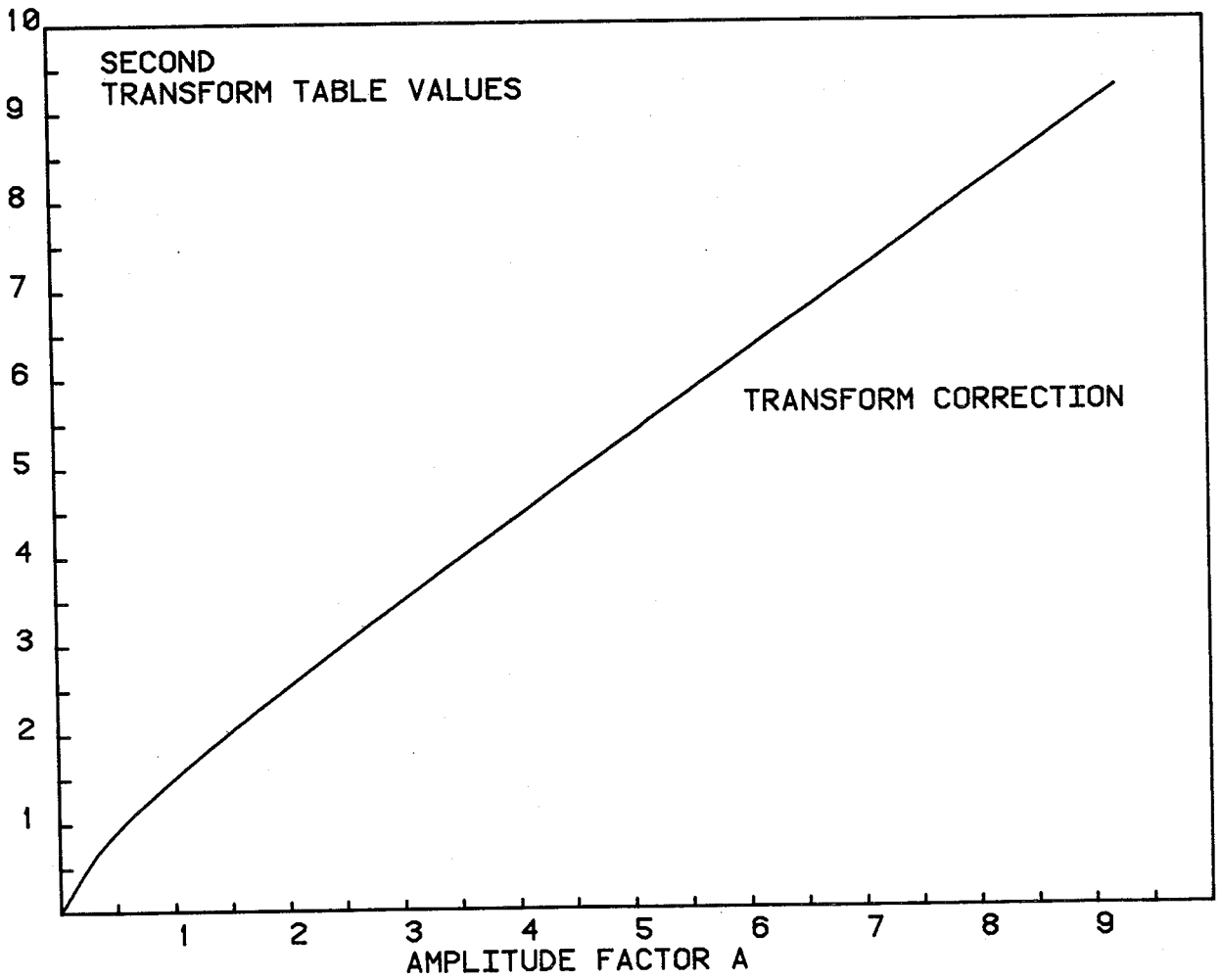
FIG. 6 is a plot of the second set of data words stored in transform table 152.
Figure 7:
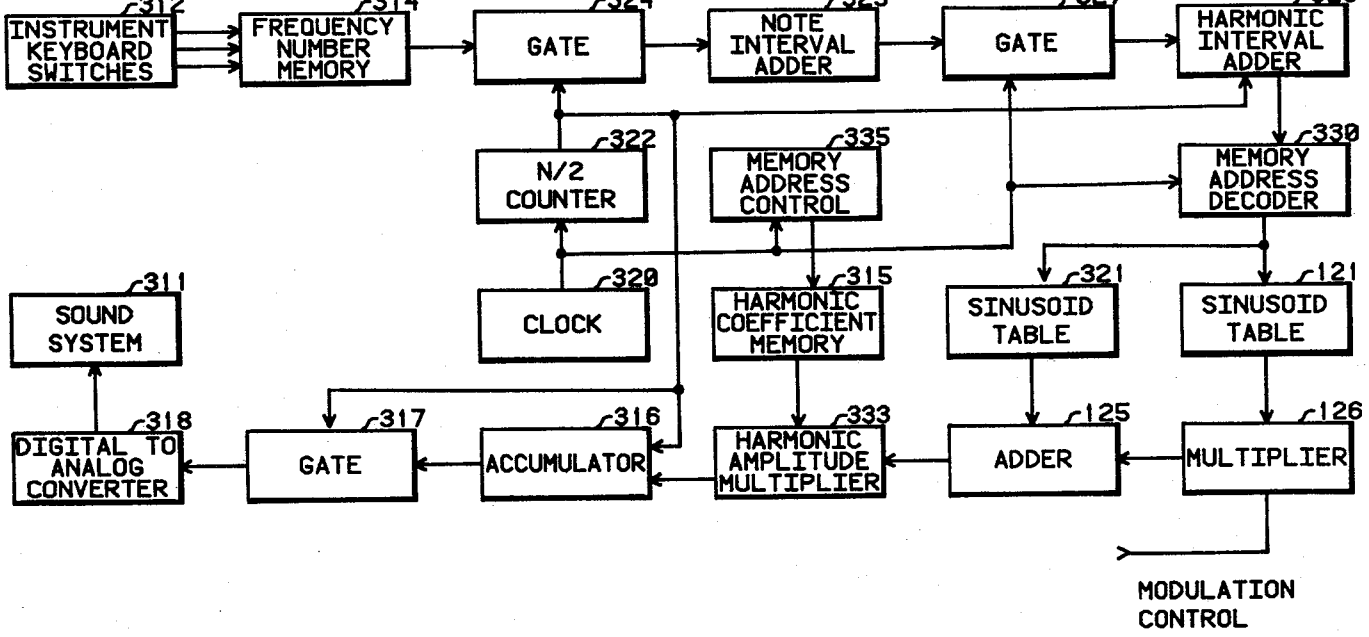
FIG. 7 is a schematic diagram of an alternate embodiment of the invention.
Figure 8:
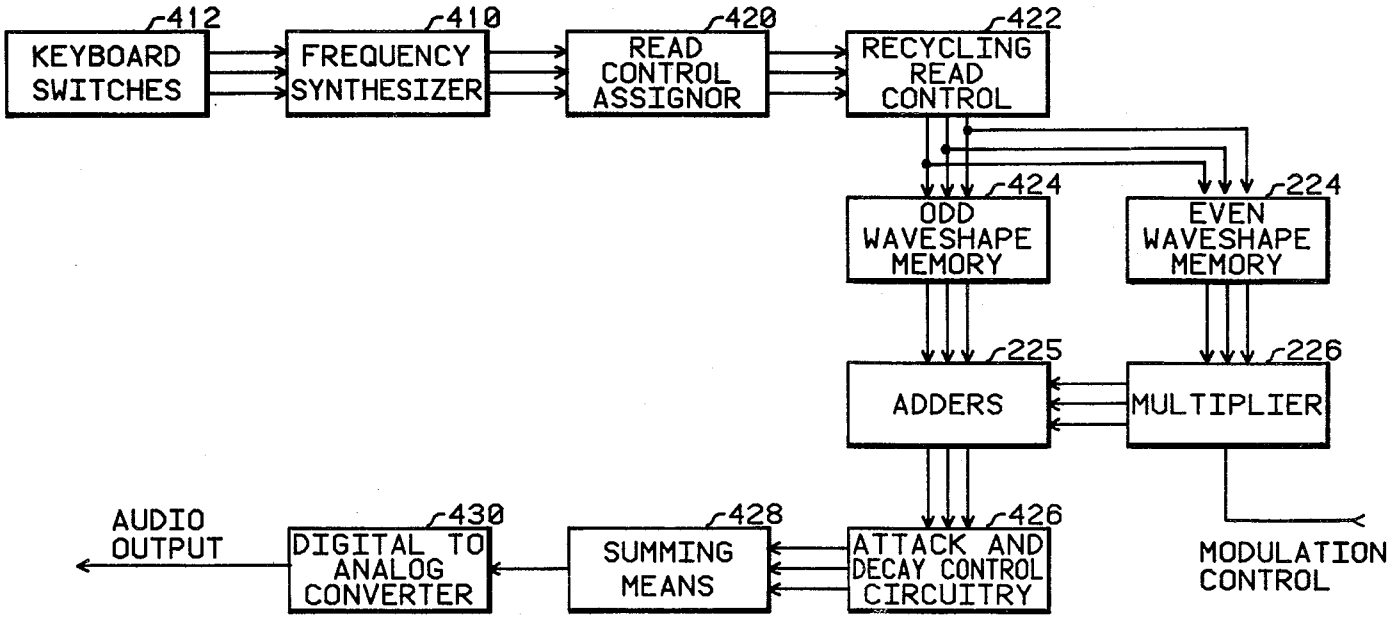
FIG. 8 is a schematic diagram of an embodiment of the invention used with a waveshape memory system.

FIG. 7 illustrates a tone generator system which incorporates the present invention into the Computer Organ described in the referenced patent. The system blocks shown in FIG. 6 are numbered to be 300 plus the corresponding block numbers shown in FIG. 1 of the referenced patent.

A closure of a keyswitch contained in the instrument keyboard switches 312 cause a corresponding frequency number to be accessed out from the frequency number memory 314. The accessed frequency number is added repetitively to the contents of the note interval adder 325. The contents of the note interval adder 325 specifies the sample point at which a waveshape amplitude value is calculated. For each sample point, the amplitude of a number of harmonic components are calculated individually by multiplying harmonic coefficient values read out of the harmonic coefficient memory 315 by the output from the adder 125. The harmonic component amplitudes are summed algebraically in the accumulator 316 to obtain the net amplitude at a sample point. The sample point amplitudes are converted into an analog signal by means of the digital-to-analog converter 318 and then furnished to the sound system 311.

The sinusoid table 321 stores values of the trigonometric function $\sin(2\pi n/64)$ and the sinuoid table 121 stores values of the trigonometric function $\cos(2\pi n/64)$. These values correspond to a waveshape having 64 points per period for the highest fundamental frequency musical pitch generated by the system.

Stored values are addressed out of the two sinusoid table in response to the content of the harmonic interval adder 328 which is decoded by means of the memory address decoder 330. The trigonometric value read out of the sinuoid table 121 is multiplied by a scale factor by means of the multiplier 126. The scale factor is introduced by the modulation control signal.

The output value read out of the sinusoid table 321 is summed with the produced value produced by the multiplier and the sum is furnished to the harmonic amplitude multiplier 333.

The linearization function of the transform table shown in FIG. 3 is also readily interposed between the source of the modulation control signal and the multiplier 126 shown in FIG. 6. Similarly a multiplier, such as multiplier 153 shown in FIG. 5, can also be used to maintain a constant amplitude as the modulation control signal is varied.

The invention can also be incorporated into tone generation systems of the type given the generic name of "waveshape in memory." In such a system the desired musical waveshapes are stored in a library of waveshape memories. Each waveshape is stored as a set of evenly spaced points corresponding to a complete period of a musical waveshape. The stored waveshapes are read out of the memory sequentially and repetitively at an address advance rate corresponding to the fundamental frequency of an actuated keyboard switch. The read out data is converted to an analog musical waveshape by means of a digital-to-analog converter. A tone generator of this type is described in U.S. Pat. No. 3,515,792 entitled "Digital Organ." This patent is hereby incorporated by reference.

Fig. 7 shows a tone generator system combining the present invention with the tone generation system described in U.S. Pat. No. 3,515,792. The system blocks shown in FIG. 7 are numbered to be 400 plus the corresponding block numbers shown in FIG. 1 of the referenced patent.

The odd waveshape memory 424 is used to store a set of data points defining a complete cycle of the selected musical tones. This set of data points is selected by a computation such that the data points have an odd symmetry about the mid point. The even waveshape memory 224 is used to store a set of data points defining a cycle of the same selected musical tones by constructed by a computation such that the data points have an even symmetry about the midpoint. The mathematical technique for constructing such waveshape points having either an even or odd symmetry is well-known. This technique is described inU.S. Pat. No. 3,763,364 entitled "Apparatus For Storing And Reading Out Periodic Waveforms." This patent is hereby incorporated by reference.

The waveshapes stored in the odd waveshape memory 424 and the even waveshape memory 224 are orthogonal to each other. The data points read out of the even waveshape memory 224 are scaled by means of the multiplier 226 corresponding to the magnitude of the modulation control signal. The scaled data values provided by the multiplier 226 are summed in the adder 225 with the data read out of the odd waveshape memory 424. The summed data from the adder 225 is scaled by the attack and decay control circuitry 426 and then furnished to the output data subsystem consisting of the summing means 428 and the digital-to-analog converter 430. The stored data is read out of the odd waveshape memory 424 and the even waveshape memory 224 by the action of recycling read control 422 in the manner described in the referenced U.S. Pat. No. 3,515,792.

The transform table 152 shown in FIG. 3 can also be used in the system shown in FIG. 7 by interposing it between the multiplier 226 and the source providing the modulation control signal. The transform table 152 and the multiplier 153 shown in FIG. 5 can also be used in conjunction with the system shown in FIG. 7.

I claim:

1. In a musical instrument having a plurality of tone generators, in which a plurality of data words corresponding to the amplitudes of points defining the waveform of a musical tone are computed and transferred sequentially to a digital-to-analog converter to be converted into musical waveshapes, apparatus for generating a frequency modulated musical tone in response to a modulation control signal comprising;

a means for generating said modulation control signal, a coefficient memory for storing a set of harmonic coefficient values, a first function means wherein a value of a first function having an odd symmetry is generated in response to an address signal, a second function means wherein a value of a second function having an even symmetry is generated in response to said address signal, a first addressing means for reading out said set of harmonic coefficient values from said coefficient memory and generating said address signal, a scaling means responsive to said modulation control signal whereby said second function value is multiplied by a number corresponding to said modulation control signal to produce a scaled second function value, an adder means whereby said first function value is summed with said scaled second function value to produce a summed function value, a means for computing, responsive to each said read out harmonic coefficient value and each said summed function value, whereby said plurality of data words corresponding to said amplitudes of points defining the waveform of said musical tone are computed, and a means for producing musical waveshapes from said plurality of data words thereby generating said frequency modulated musical tone in response to said modulation control signal.

2. In a musical instrument according to claim 1 wherein said first function means comprises a first memory means storing a plurality of first function values and wherein said second function means comprises a second memory means storing a plurality of second function values.

3. In a musical instrument according to claim 1 wherein said first function means comprises a first memory means storing values of the trigonometric function $\sin(2\pi n/N)$ and wherein said second function means comprises a second memory means storing values of the trigonometric function $\cos(2\pi n/N)$ where the memory address number n is an integer having values in the range of 1 to N and where N is the number of points in said plurality of data words corresponding to the amplitudes of points defining said waveform of a musical tone.

4. In a musical instrument according to claim 1 wherein said scaling means comprises;

a first transform table for storing a plurality of first transform data values, a second addressing means for reading out one of said first transform data values from said first transform table in response to said modulation control signal, and a first multiplier means wherein said second function value generated in response to said address signal is multiplied by one of said first transform data values read out from said first transform table to produce said scaled second function value.

5. In a musical instrument according to claim 1 wherein said scaling means comprises;

a second transform table for storing a plurality of second transform data values, a second addressing means for reading out one of said second transform data values from said transform table in response to said modulation control signal, and a second multiplier means whereby said summed function value is multiplied by one of said second transform data values read out from said second transform table to produce a scaled summed function value which is provided to said means for computing replacing said summed function value.

6. In a musical instrument accoring to claim 1 wherein said means for computing comprises;

a main memory means for storing said plurality of data words corresponding to the said waveform of a musical tone computed during each computation cycle in a sequence of computation cycles, a clock means for providing timing signals, a word counter for counting said timing signals modulo the number of said plurality of data words stored in said main memory means, a harmonic counter incremented each time said word counter returns to its minimal count state, an adder-accumulator means wherein the count state of said harmonic counter is successively added to the contents of an accumulator in response to said timing signals and wherein the content of said accumulator is initialized to a zero value at the start of each computation cycle, a third multiplying means for multiplying said read out harmonic coefficient value by said summed function value, and a means for successively summing the output from said third multiplying means with values read out from said main memory means in response to the count state of said word counter and whereby the summed values are stored in said main memory means.

7. In a keyboard musical instrument in which a plurality of data words are computed at regular time intervals corresponding to the combination of a number of tone generators and converted into musical waveshapes, apparatus for generating a frequency modulated musical tone in response to a modulation control signal comprising;

a means for generating said modulation control signal, a coefficient memory for storing a set of harmonic coefficient values, a first function means wherein a first value of a function having an odd symmetry is generated in response to an address signal, a second function means wherein a second value of a function having an even symmetry is generated in response to said address signal, a first addressing means for reading out said set of harmonic coefficient values from said coefficient memory and generating said address signal, a scaling means responsive to said modulation control signal whereby said second function value is multiplied by a number corresponding to said modulation control signal, an adder means whereby said first function value is summed with said scaled second function value to produce a summed function value, a means for computing, responsive to each said read out harmonic coefficient value and each said summed function value, for computing at regular time intervals a sequence of data words each of which corresponds to said combination of a number of tone generators, and a means for producing musical waveshapes from said sequence of data words thereby generating said frequency modulated musical tone in response to said modulation control signal.

8. In a musical instrument according to claim 7 wherein said first function means comprises a first memory means storing a plurality of first function values and wherein said second function means comprises a second memory means storing a plurality of second function values.

9. In a musical instrument according to claim 8 wherein said first function means comprises a first memory means storing values of the trigonometric function sine function and wherein said second function means comprises a second memory means storing values of the trigonometric cosine function.

10. In a musical instrument according to claim 7 wherein said scaling means comprises:

a first transform table for storing a plurality of first transform data values, a second addressing means for reading out one of said first transform data values from said transform table in response to said modulation control signal, and a first multiplier means wherein said second function value generated in response to said address signal is multiplied by one of said first transform data values read out from said first transform table to produce said scaled second function value.

11. In a musical instrument according to claim 7 wherein said scaling means comprises;

a second transform table for storing a plurality of second transform data values, a second addressing means for reading out one of said second transform data values from said transform table in response to said modulation control signal, and a second multiplier means whereby said summed function value is multiplied by one of said second transform data values read out from said second transform table to produce a scaled summed function value which is provided to said means for computing replacing said summed function value.

12. In a musical instrument according to claim 7 wherein said means for computing comprises;

a means for generating a frequency number, a note interval adder wherein said frequency number is successively added to the sum previously contained in said note interval adder, a harmonic interval adder wherein the content of said note interval adder is successively added to the sum contained in said harmonic interval adder, a third multiplier means for multiplying said read out harmonic coefficient value by said summed function value, and a means for successively summing the output from said third multiplier means thereby creating said sequence of data words each of which corresponds to said combination of a number of tone generators.

13. In a musical instrument in which stored data points corresponding to a waveform of a musical waveshape are read out sequentially and repetitively and transferred to a digital-to-analog converter to be converted into musical waveshapes, apparatus for generating a frequency modulated musical tone in response to a modulation control signal comprising;

a means for generating said modulation control signal, a first waveshape memory storing a first set of data points corresponding to said waveform of a musical waveshape and wherein said first set of data points has an even symmetry, a second waveshape memory storing a second set of data points corresponding to said waveform of a musical waveshape and wherein said second set of data points has an odd symmetry, a means for repetitiously reading out said first set of data points and said second set of data points at a selectable rate, a scaling means responsive to said modulation control signal whereby said second set of data points read out of said second waveshape memory are multiplied by a number corresponding to said modulation control signal to produce a set of scaled waveshape data values, an adder means whereby each one of said first data set points read out of said first waveshape memory is added to a corresponding one of said set of scaled waveshape data values to produce a set of summed waveshape data points, and a means for producing musical waveshapes from said set of summed waveshape data points thereby producing said frequency modulated musical tone in response to said modulation control signal.

* * * * *